US005557954A

United States Patent [19]

Ling

[11] Patent Number: 5,557,954

[45] Date of Patent: Sep. 24, 1996

[54] COMBINATION LOCK WITH DUALLY DEPRESSIBLE PUSH BUTTONS

[76] Inventor: Chong-Kuan Ling, c/o Sinox Co., Ltd. P. O. Box 96-156, Taipei, Taiwan

[21] Appl. No.: 463,715

[22] Filed: Jun. 5, 1995

[51] Int. Cl.[6] ..... E05B 67/38

[52] U.S. Cl. ..... 70/68; 70/312; 70/69

[58] Field of Search ..... 70/68, 312, 304, 70/70, 71, 72, 74, 69; 24/387

[56] References Cited

U.S. PATENT DOCUMENTS

| | | | |
|---|---|---|---|
| 3,973,419 | 8/1976 | Atkinson | 70/68 |
| 4,884,419 | 12/1989 | Ling | 70/68 X |
| 4,974,432 | 12/1990 | Blake | 70/68 |
| 5,063,760 | 12/1991 | Horita et al. | 70/68 X |
| 5,136,864 | 8/1992 | Spiekermann et al. | 70/68 |
| 5,193,368 | 3/1993 | Ling | 70/312 X |
| 5,307,654 | 5/1994 | Ling | 70/71 |
| 5,485,734 | 1/1996 | Yang | 70/71 X |

*Primary Examiner*—Steven N. Meyers
*Assistant Examiner*—Monica E. Millner

[57] ABSTRACT

A combination lock includes: a lock body having dials and sleeves rotatably mounted in the lock body, a pair of push-button members resiliently disposed on two opposite ends of the lock body, and a pair of locking tongue members each integrally linked with each push-button member for locking a pull tab of a zipper or a latch member of an article to be locked, whereby upon depression of the two push-button members to retract the two tongue members, the pull tabs or the latch members will be unlocked ergonomically and conveniently.

7 Claims, 4 Drawing Sheets

COMBINATION LOCK WITH DUALLY DEPRESSIBLE PUSH BUTTONS

BACKGROUND OF THE INVENTION

A zipper locking device for luggage cases of U.S. Pat. No. 4,854,139 to Scelba comprises a loop (14) pivotally mounted on a housing for trapping and locking a pair of sliders of a zipper fastener on a luggage case, and the housing provided with a combination lock which may be unlocked for lifting the loop to free the sliders.

However, whenever locking the sliders of the zipper fastener on the luggage case, the two pull tabs (36A) and the two sliders (36) should be carefully and linearly arranged on the base portion (86) of the housing frame (44) in order to be trapped into chamber (88) of the loop (14) for locking the sliders of zipper. Once the luggage case is moved or vibrated inadvertently, the pull tabs may be pivotally slid away from the trap location of the loop (14), thereby causing an inconvenient locking operation of the zipper locking apparatus.

SUMMARY OF THE INVENTION

The object of the presnet invention is to provide a combination lock for conveniently locking two pull tabs of a zipper fastener on a luggage case or for locking two latch members of other articles to be locked.

According to the present invention, a combination lock includes: a lock body having dials and sleeves rotatably mounted in the lock body, a pair of push-button members resiliently disposed on two opposite ends of the lock body, and a pair of locking tongue members each integrally linked with each push-button member for locking a pull tab of a zipper or a latch member of an article, whereby upon depression of the two push-button members to retract the two tongue members, the pull tabs or the latch members will be unlocked for an ergonomic and convenient unlocking or locking operation of the combination lock.

DETAILED DESCRIPTION

Figure 8:
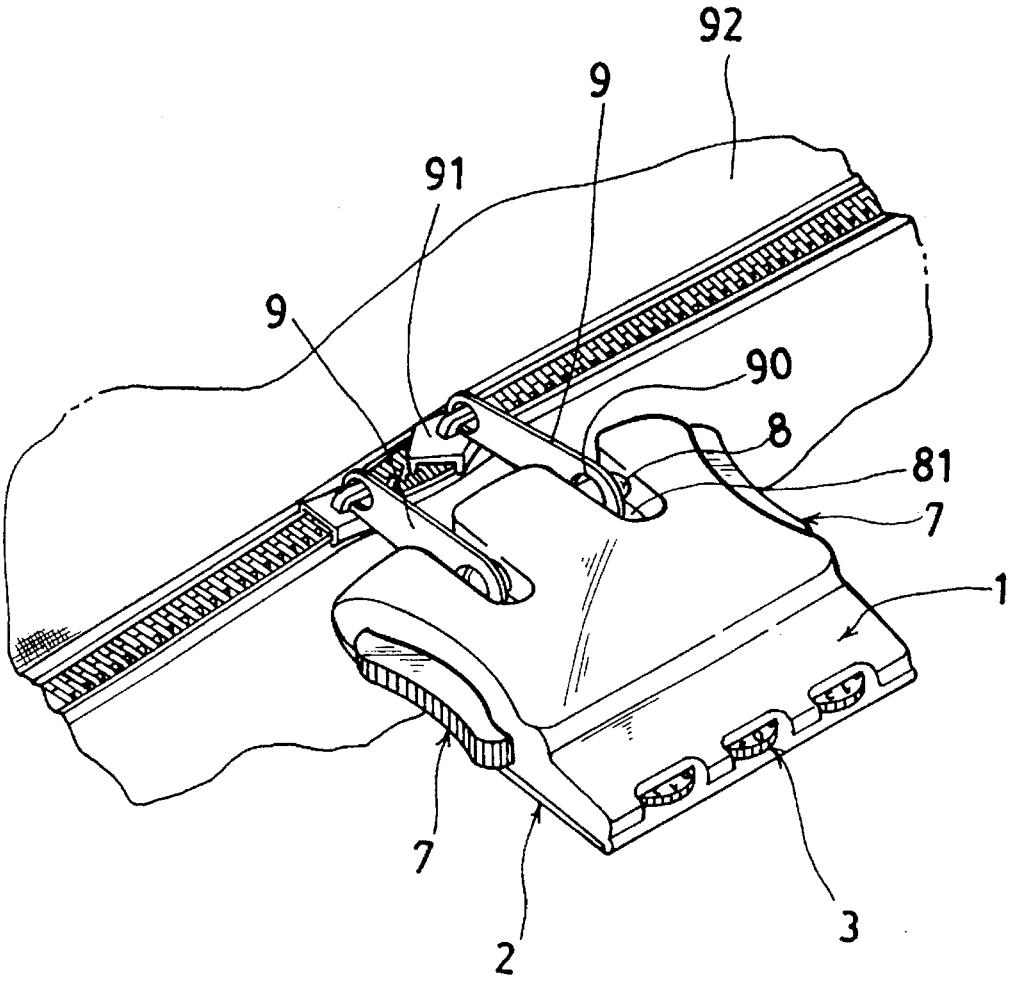
FIG. 8 is a perspective illustration of the present invention when used for locking a zipper fastener locking apparatus.

As shown in the drawing figures, the present invention comprises: a lock body 1, a cover 2 combinable with the lock body 1, a plurality of dials 3 and sleeves 4 rotatably mounted in the lock body 1 with each dial 3 resiliently coupled with each sleeve 4, a control slide 5 slidably held in the lock body 1, a retarding means 6 controlled by the control slide 5, a pair of push-button members 7 resiliently held in the lock body 1 to be retarded by the retarding means 6 when locked, and a pair of locking tongue members 8 each tongue member 8 integrally secured to each push-button member 7 for locking a latch member 9 such as for engaging a latch hole 90 of a pull tab of a zipper slide 91 formed on a luggage case 92 as shown in FIG. 8.

The latch member 9 may be defined as a U shaped shackle of a bicycle lock or a hasp of other locks, not limited in this invention. The lock body 1 may be secured on any article either fixed or movable.

The lock body 1 includes: an elongate cavity 11 formed in a dial side A of the lock body 1, a plurality of stems 12 longitudinally formed in the elongate cavity 11 for rotatably mounting the plurality of dials 3 and sleeves 4 in the stems 12 having a longitudinal axis 120 defined at the center of the elongate cavity 11 and aligned with each center of the stem 12, a spring holder 13 formed at a first end C of the lock body adjacent to the dial side A for retaining a restoring spring 54 of the control slide 5, an intermediate socket 14 recessed in a central portion of the lock body 1 having a pair of pivots 140 formed in the intermediate socket 14 for rotatably mounting the retarding means 6 in the intermediate socket 14, a pair of button chambers 16 respectively recessed in two opposite end portions of the lock body 1 at the latch side B for respectively holding the two push-button members 7 in the button chambers 16, with a middle chamber 17 positioned in between the two button chambers 16 for storing a tension spring 73 of the push-button members 7, each button chamber 16 having a guiding post 15 formed therein for slidably guiding a reciprocative movement of each push-button member 7 along the guiding post 15, and a pair of insertion openings 10 notched in the lock body 1 at the latch side B for inserting the two latch members 9 in the two insertion openings 10 for locking the two latch members (or two pull tabs of a zipper) 9 with the two tongue members 8.

The control slide 5 includes: a slide plate 50 slidably held in the lock body 1, a plurality of sleeve slots 51 longitudinally recessed in the slide plate 50 along the longitudinal axis 120 in the elongate cavity 11 of the lock body 1 for respectively engaging the plurality of sleeves 4 in the sleeve slots 51, each sleeve slot 51 having a taper extension 52 protruding from an edge portion of the sleeve slot 51 at the first end C of the lock body 1 and tapered towards each center of the stem 12 of the lock body 1 to be engageable with a notch 41 which is recessed and tapered in each sleeve 4 when unlocking the combination lock of this invention, a retaining rod 53 retained on a restoring spring 54 secured on the spring holder 13 at a first end of the lock body 1 for normally urging the slide plate 50 towards the second end D of the lock body 1, and a driving rod 55 protruding from a side edge portion of the slide plate 50 of the control slide 5 towards the intermediate socket 14 in the lock body 1 to be movably engageable with a spiral groove 63 spirally recessed in the retarding means 6; with each sleeve slot 51 having a minimum length D larger than a diameter d of each sleeve 4 for a smooth engagement or disengagement between the sleeves 4 and the slide plate 50.

Figure 2:
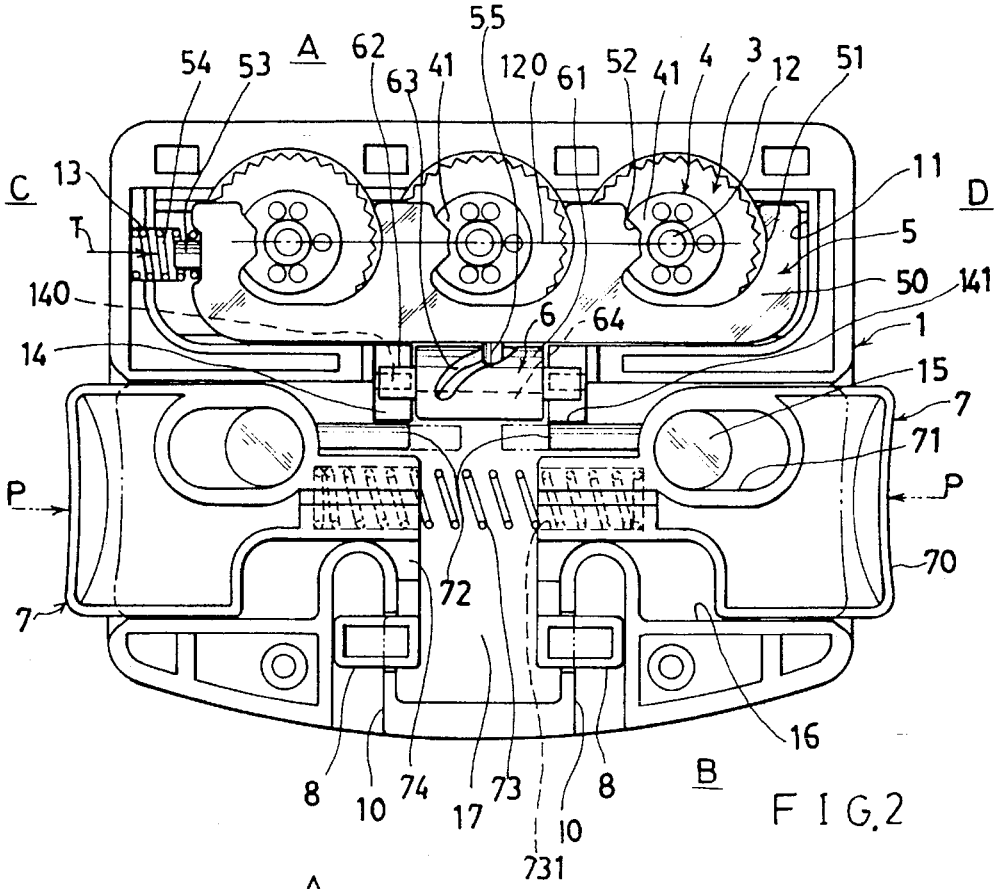
FIG. 2 is a bottom-view illustration showing an openable condition of the present invention.
Figure 4:
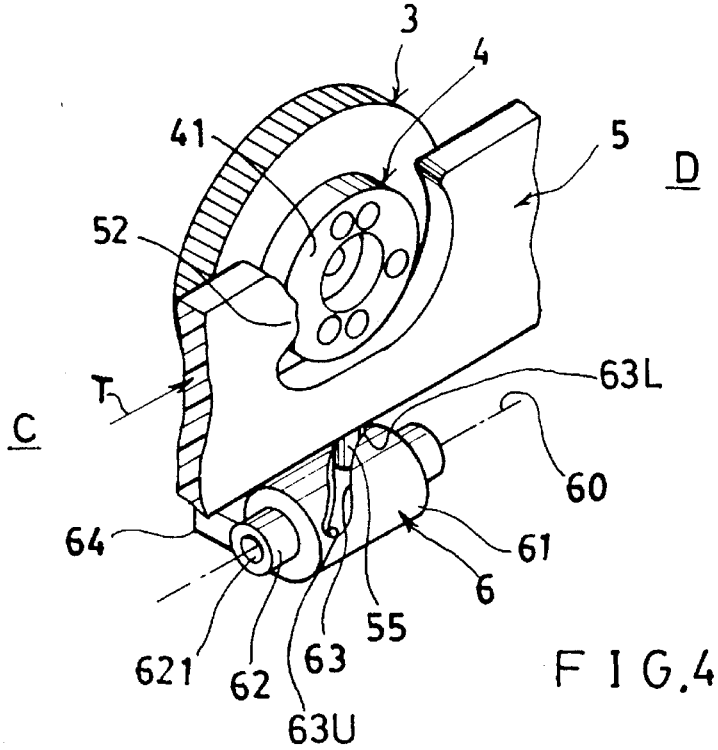
FIG. 4 shows an unlocking condition of the present invention derived from FIG. 3.
Figure 3:
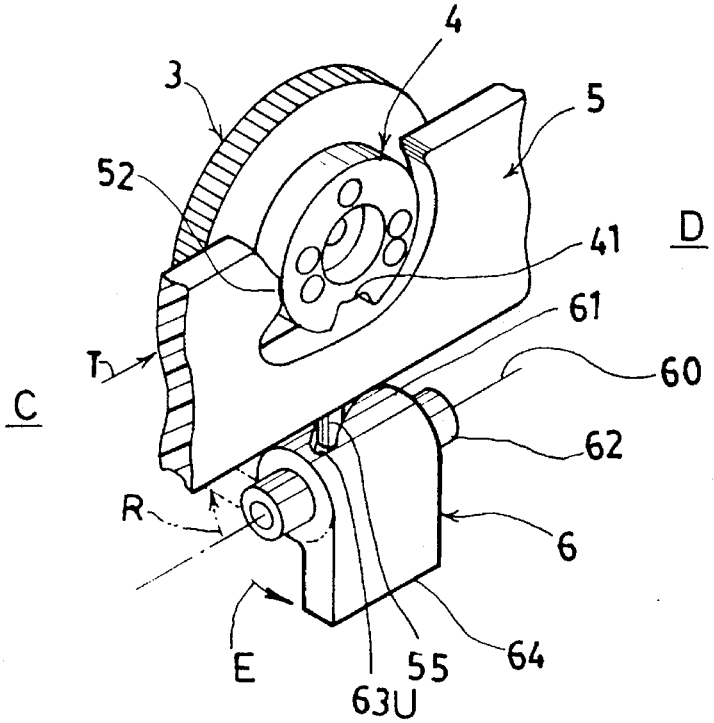
FIG. 3 is an illustration showing a locked condition of several related elements of the present invention.
Figure 6:
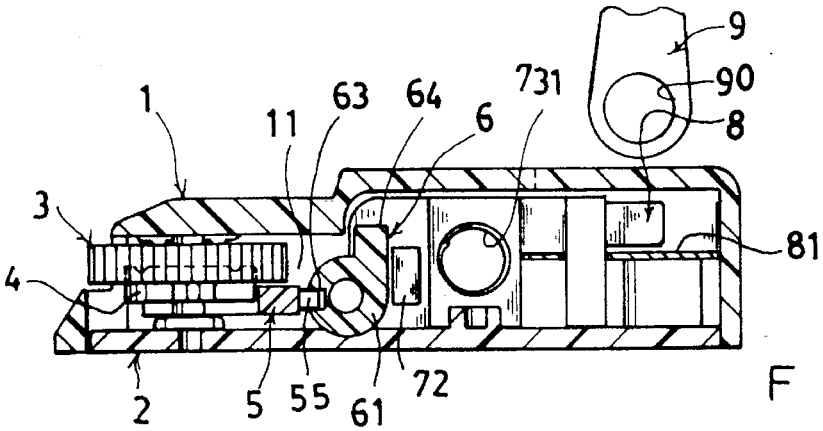
FIG. 6 is a cross sectional drawing of the present invention when viewed from 6—6 direction of FIG. 5.
Figure 5:
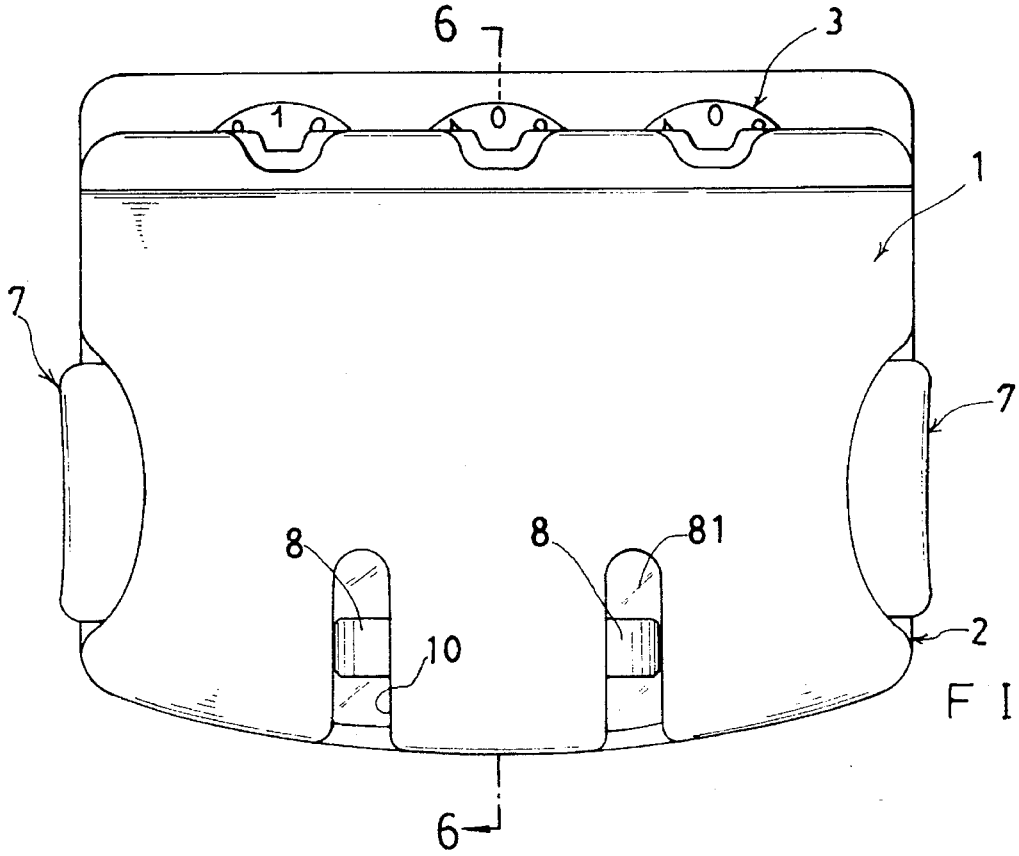
FIG. 5 is a top view of the present invention when assembled.

The retarding means 6 includes: a shaft member 61 having a pair of sheaths 62 disposed on two opposite ends of the shaft member 61 each sheath 62 formed with a pivot hole 621 therein for rotatably engaging each pivot 140 in the lock body 1 to rotatably mount the shaft member 61 in the lock body 1 about a shaft axis 60 which is defined at a center of the shaft member 61 and parallel to the longitudinal axis 120, the spiral groove 63 spirally recessed in the shaft member 61 to be engageable with the driving rod 55 of the control slide 5, and a retarding plate 64 protruding outwardly from the shaft member 61 to be generally tangential to the circumference of the shaft member 61 to be projectively perpendicular to the shaft axis 60; with the spiral groove 63 having a lower deadpoint 63L at a lower end portion of the spiral groove 63 for engaging the driving rod 55 of the control slide 5 for biasing the retarding plate 64 to a retracted position as shown in FIG. 4 as retracted (R) from FIG. 3 when the slide plate 50 is restored by the spring 54 (T) from a first end C towards a second end D of the lock body 1 (FIG. 2) when unlocking the combination lock for preventing retarding of the two push-button members 7 thereby allowing a free depressing (P) of the push-button members 7 for unlocking the combination lock; and with the spiral groove 63 having an upper deadpoint 63U at an upper end portion of the groove 63 for engaging the driving rod 55 for biasing the retarding plate 64 to an extended position as shown in FIG. 3 as extended (E) from FIG. 4 when the slide plate 50 is thrusted towards the first end C as driven by the sleeves 4 when locking the combination lock, thereby retarding the depressing of two inner pins 72 of the two push-button members 7 and preventing retraction of the two tongue members 8 in order for locking the combination lock.

Figure 1:
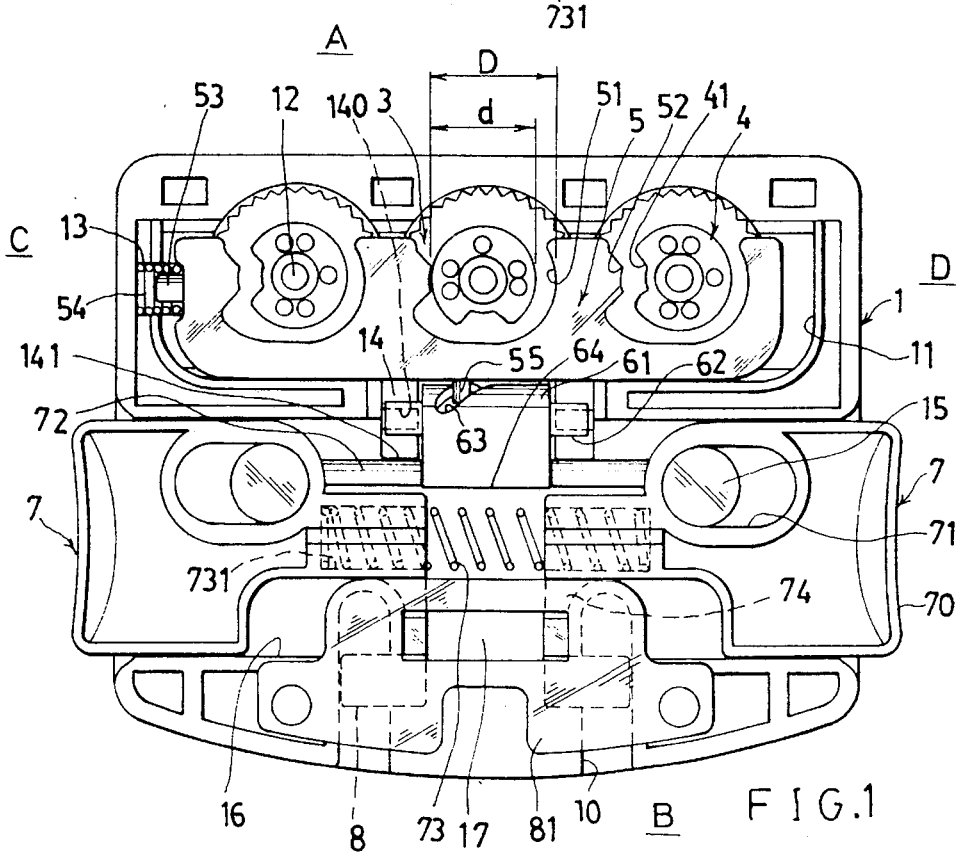
FIG. 1 is a bottom exploded view of the present invention.

Each push-button member 7 includes: a push-button portion 70 having a sliding slot 71 cut out in the push-button portion 70 to be slidably guided in each button chamber 16 about a guiding post 15 to be depressed by a user, an inner pin 72 protruding inwardly from the push-button portion 70 to be retarded against the retarding plate 64 when unlocked as shown in FIG. 1, a tension spring 73 held in a spring socket 731 recessed in an inner end of the push-button portion 70 and retained in between the two push-button members 7 for urging the two push-button members 7 outwardly beyond the button chambers 16 to be ready for depression, and a cantilever portion 74 transversely protruding from the push-button portion 70 towards the latch side B of the lock body 1 to be connected with each locking tongue member 8 normally poking into the insertion opening 10 in the lock body 10 for locking the latch member 9.

Figure 7:
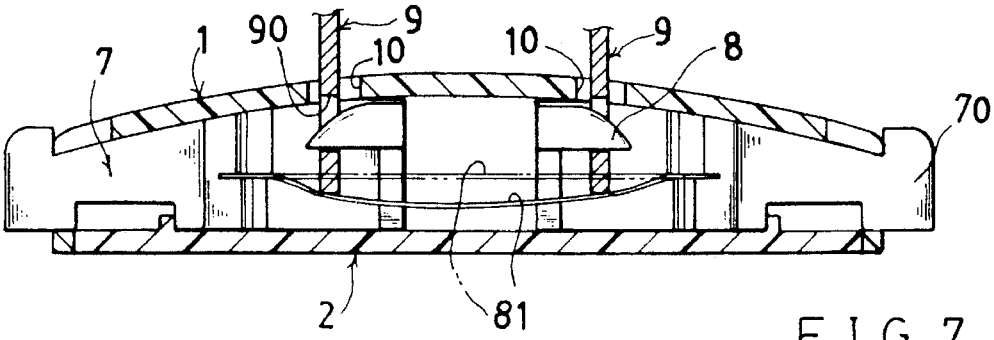
FIG. 7 is a sectional drawing of the present invention when locking the pull tabs of a zipper fastener.

Each locking tongue member 8 has a cushioning spring 81 secured in the lock body 1 under the tongue member 8 for resiliently contacting the latch member 9 when locked with the tongue member 8 as shown in FIG. 7 so as to eject the latch member 9 when unlocking the lock for an easy removal of the latch member 9 from the lock body 1.

When unlocking the lock of the present invention at a correct opening combination as shown in FIG. 2, the extensions 52 of the slide 5 are each engaged with the notch 41 of each sleeve 4 to allow a thrusting (T) of the slide 5 towards the second end D as restored by the spring 54 to bias the retarding plate 64 without retarding the pins 72 of the two push-button members 7, thereby allowing a depression P of each push-button member 7 for retracting each tongue member 8 for disengaging the latch member 9 for unlocking purpose.

By continuously depressing the push-button members 7 to inwardly protrude the inner pins 72 to obstruct an extending operation (E) of the retarding plate 64 to brake a rotation of the shaft member 61 and stop a thrusting movement of the slide plate 50 to engage the extensions 52 with the sleeve notches 41 to lock the sleeves 4, thereby allowing a free rotation of dials 3 for re-setting a new combination.

The present invention is superior to the conventional zipper locking apparatus with the following advantages:

1. Two push-button members 7 and two tongue members 8 are symmetrically disposed on two opposite sides of the lock body for an ergonomic depression for unlocking the lock.

2. Each tongue member 8 may be engaged with each latch hole 90 of the latch member 99 to ensure a reliable locking of the latch member.

3. During the locking operation, each latch member such as the pull tab of the zipper slide can be instantly inserted into each insertion opening 10 to be locked in situ on the lock body, thereby eliminating the inconvenient pre-arrangement to carefully rest the zipper sliders and pull tabs on the base to be trapped into the loop such as disclosed in U.S. Pat. No. 4,854,139.

4. Flat, compact and slim design with reduced volume of the lock body and locking mechanism of the present invention can be achieved for better commercial values.

The present invention may be modified without departing from the spirit and scope of this invention.

I claim:

1. A combination lock comprising:

a lock body combinable with a cover thereon;

a plurality of dials and sleeves rotatably mounted in said lock body;

a control slide slidably held in a first portion of said lock body and operatively driven by said sleeves and dials to a locking position and normally restored to an unlocking position when the dials and sleeves are set in an unlocking combination;

a retarding means pivotally mounted in a central portion in said lock body and engageable with said control slide;

a pair of push-button members resiliently held in two opposite end portions in a second portion of said lock body opposite to said control slide; and a pair of locking tongue members each said locking tongue member integrally connected with each said push-button member and normally protruding into an insertion opening notched in the second portion of said lock body for locking a latch member of an article to be locked;

said control slide operatively biasing said retarding means for retarding depression of said push-button members for a locking;

and upon dialing of a correct combination of the dials to restore said control slide to retract said retarding means, said push-button members will not be retarded and will be depressed for an unlocking.

2. A combination lock according to claim 1, wherein said lock body includes an elongate cavity formed in a dial side of the lock body, a plurality of stems longitudinally formed in the elongate cavity for rotatably mounting the plurality of dials and sleeves in the stems, a spring holder formed at a first end of the lock body adjacent to the dial side for retaining a restoring spring of the control slide, an intermediate socket recessed in a central portion of the lock body for rotatably mounting the retarding means in the intermediate socket, a pair of button chambers respectively recessed in two opposite end portions of the lock body at a latch side of the lock body for respectively holding the two push-button members in the button chambers, and a pair of insertion openings notched in the lock body at the latch side for inserting two latch members in the two insertion openings for locking the two latch members with the two tongue members.

3. A combination lock according to claim 2, wherein said control slide includes:

a slide plate slidably held in the lock body, a plurality of sleeve slots longitudinally recessed in the slide plate for respectively engaging the plurality of sleeves in the sleeve slots, each said sleeve slot having a taper extension tapered towards each center of the stem of the lock body to be engageable with a notch which is recessed and tapered in each said sleeve when unlocking the combination lock, a retaining rod retained on a restoring spring secured on the spring holder at the first end of the lock body for normally urging the slide plate towards a second end of the lock body to engage said sleeves, and a driving rod protruding from a side edge portion of the slide plate of the control slide towards the intermediate socket in the lock body to be movably engageable with the retarding means.

4. A combination lock according to claim 3, wherein said retarding means includes:

a shaft member having a pair of sheaths disposed on two opposite ends of the shaft member each said sheath formed with a pivot hole therein for rotatably engaging a pivot formed in the lock body to rotatably mount the shaft member in the lock body, a spiral groove spirally recessed in the shaft member to be engageable with the driving rod of the control slide, and a retarding plate protruding outwardly from the shaft member to be generally tangential to a circumference of the shaft member; said spiral groove engageable with the driving rod of the control slide for biasing the retarding plate to a retracted position when the slide plate is restored when unlocking the combination lock for preventing retarding of the two push-button members for allowing a free depressing of the push-button members for unlocking the combination lock; and said spiral groove operatively biasing the retarding plate to an extended position when the slide plate is driven by the sleeves when locking the combination lock, thereby retarding the depressing of two said push-button members for locking the combination lock.

5. A combination lock according to claim 4, wherein each said push-button member includes:

a push-button portion having a sliding slot cut out in the push-button portion to be slidably guided in each said button chamber by a guiding post formed in said lock body, an inner pin protruding inwardly from the push-button portion to be retarded against the retarding plate when unlocked, a tension spring held in a spring socket recessed in an inner end of the push-button portion and retained in between the two push-button members for urging the two push-button members outwardly beyond the button chambers to be ready for depression, and a cantilever portion transversely protruding from the push-button portion towards said latch side of the lock body to be connected with said locking tongue member normally poking into the insertion opening in the lock body for locking said latch member.

6. A combination lock according to claim 5, wherein each said locking tongue member has a cushioning spring secured in said lock body under the tongue member for resiliently contacting the latch member in order to eject the latch member when unlocking the lock for an easy removal of the latch member from the lock body.

7. A combination lock according to claim 6, wherein said latch member is a pull tab of a zipper fastener formed on a luggage case.

* * * * *